US010801742B2

(12) United States Patent
Goel et al.

(10) Patent No.: US 10,801,742 B2
(45) Date of Patent: Oct. 13, 2020

(54) METHOD AND APPARATUS FOR RE-HEAT CIRCUIT OPERATION

(71) Applicant: Lennox Industries Inc., Richardson, TX (US)

(72) Inventors: Rakesh Goel, Irving, TX (US); Wenqian Liu, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 20 days.

(21) Appl. No.: 15/948,102

(22) Filed: Apr. 9, 2018

(65) Prior Publication Data

US 2019/0309965 A1 Oct. 10, 2019

(51) Int. Cl.

| | |
|---|---|
| ***F24F 3/153*** | (2006.01) |
| ***F24F 11/30*** | (2018.01) |
| ***F24F 13/30*** | (2006.01) |
| ***F24F 11/67*** | (2018.01) |
| ***F24F 11/84*** | (2018.01) |
| ***F25B 39/02*** | (2006.01) |
| ***F25B 41/06*** | (2006.01) |
| ***F25B 41/00*** | (2006.01) |
| ***F25B 13/00*** | (2006.01) |
| ***F25B 40/04*** | (2006.01) |

(52) U.S. Cl.

CPC ..... *F24F 3/153* (2013.01); *F24F 11/30* (2018.01); *F24F 11/67* (2018.01); *F24F 11/84* (2018.01); *F24F 13/30* (2013.01); *F24F 2203/021* (2013.01)

(58) Field of Classification Search

CPC .. F24F 3/153; F24F 13/30; F24F 11/67; F24F 11/84; F24F 2203/021; F25B 41/003; F25B 13/00; F25B 40/04

USPC ..... 62/324.6

See application file for complete search history.

(56) References Cited

U.S. PATENT DOCUMENTS 3,977,205 A 8/1976 Dreisziger et al.
6,023,940 A * 2/2000 Abbott ..... B01F 5/0682 210/445
6,026,654 A 2/2000 Park
(Continued)

FOREIGN PATENT DOCUMENTS

CA 2968798 A1 * 12/2017 ..... F25B 41/04
CN 106052200 A 10/2016
(Continued)

OTHER PUBLICATIONS

U.S. Appl. No. 15/948,049, Goel et al.

*Primary Examiner* — Steve S Tanenbaum
(74) *Attorney, Agent, or Firm* — Shackelford, Bowen, McKinley & Norton, LLP

(57) ABSTRACT

A metering device is fluidly coupled to the condenser coil. A distributor is fluidly coupled to the metering device. An evaporator coil is fluidly coupled to the distributor via a plurality of evaporator circuit lines. A re-heat coil is disposed adjacent to the evaporator coil. The re-heat coil includes a first fluid connection to the metering device via a re-heat return line and a second re-heat feed line. The re-heat coil includes a second fluid connection to the condenser coil via a connecting line and a condenser intake line. A first check valve is disposed between the connecting line and the condenser intake line. A second check valve is disposed between the re-heat return line and the second re-heat feed line.

8 Claims, 8 Drawing Sheets

(56) References Cited

U.S. PATENT DOCUMENTS

| | | | | |
|---|---|---|---|---|
| 6,138,919 | A | 10/2000 | Cooper et al. | |
| 6,338,254 | B1 | 1/2002 | Alsenz | |
| 6,381,974 | B1 | 5/2002 | Hwang et al. | |
| 7,770,405 | B1 | 8/2010 | Dillon | |
| 9,599,353 | B2 | 3/2017 | Cur et al. | |
| 2006/0288713 | A1 | 12/2006 | Knight et al. | |
| 2008/0302112 | A1* | 12/2008 | Anderson | F25B 45/00 62/93 |
| 2014/0041402 | A1 | 2/2014 | Thogersen et al. | |
| 2015/0013356 | A1 | 1/2015 | Karkhanis et al. | |
| 2015/0083378 | A1 | 3/2015 | Banach | |
| 2016/0178222 | A1 | 6/2016 | Bush et al. | |
| 2016/0334129 | A1 | 11/2016 | Shinoda et al. | |
| 2017/0153037 | A1 | 6/2017 | Goel et al. | |
| 2018/0094841 | A1 | 4/2018 | Kester et al. | |

FOREIGN PATENT DOCUMENTS

| | | | |
|---|---|---|---|
| CN | 106642831 | A | 5/2017 |
| WO | WO-2015083378 | A1 | 6/2015 |

* cited by examiner

METHOD AND APPARATUS FOR RE-HEAT CIRCUIT OPERATION

TECHNICAL FIELD

The present disclosure relates generally to heating, ventilation, and air conditioning (HVAC) systems and applications and more particularly, but not by way of limitation, to utilizing a re-heat coil in both a re-heat mode and a cooling mode.

BACKGROUND

This section provides background information to facilitate a better understanding of the various aspects of the disclosure. It should be understood that the statements in this section of this document are to be read in this light, and not as admissions of prior art.

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air). To direct operation of the circulation fan and other components, HVAC systems include a controller. In addition to directing operation of the HVAC system, the controller may be used to monitor various components, (i.e. equipment) of the HVAC system to determine if the components are functioning properly.

SUMMARY

This summary is provided to introduce a selection of concepts that are further described below in the detailed description. This summary is not intended to identify key or essential features of the claimed subject matter, nor is it to be used as an aid in limiting the scope of the claimed subject matter.

In one aspect, the present disclosure relates to a heating, ventilation, and air conditioning ("HVAC") system. The HVAC system includes a condenser coil. A metering device is fluidly coupled to the condenser coil. A distributor is fluidly coupled to the metering device. An evaporator coil is fluidly coupled to the distributor via a plurality of evaporator circuit lines. A re-heat coil is disposed adjacent to the evaporator coil. The re-heat coil includes a first fluid connection to the metering device via a re-heat return line and a second re-heat feed line. The re-heat coil includes a second fluid connection to the condenser coil via a connecting line and a condenser intake line. A first check valve is disposed between the connecting line and the condenser intake line. A second check valve is disposed between the re-heat return line and the second re-heat feed line.

In another aspect, the present invention relates to an evaporator coil. The evaporator coil includes a primary segment that receives refrigerant from a condenser coil and discharges refrigerant to a compressor. A secondary segment is fluidly coupled to the compressor via a reversing valve. The secondary segment includes a first fluid connection to the condenser coil via a re-heat return line and a second re-heat feed line. The secondary segment includes a second fluid connection to the condenser coil via a condenser intake line. In a re-heat mode, the secondary segment receives refrigerant from the compressor and discharges refrigerant to the condenser coil via the second fluid connection. In a cooling mode, the secondary segment receives refrigerant from the condenser coil via the second fluid connection and discharges refrigerant to the compressor.

In another aspect, the present invention elates to a heating, ventilation, and air conditioning ("HVAC") system. The HVAC system includes a condenser coil. A metering device is fluidly coupled to the condenser coil. A distributor is fluidly coupled to the metering device. A segmented evaporator coil is fluidly coupled to the distributor via a plurality of evaporator circuit lines. The segmented evaporator coil includes a primary segment that receives refrigerant from the condenser coil and a secondary segment. The secondary segment includes a first fluid connection to the metering device. The secondary segment includes a second fluid connection to the condenser coil. A first check valve is disposed in the second fluid connection. A second check valve is disposed in the first fluid connection.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
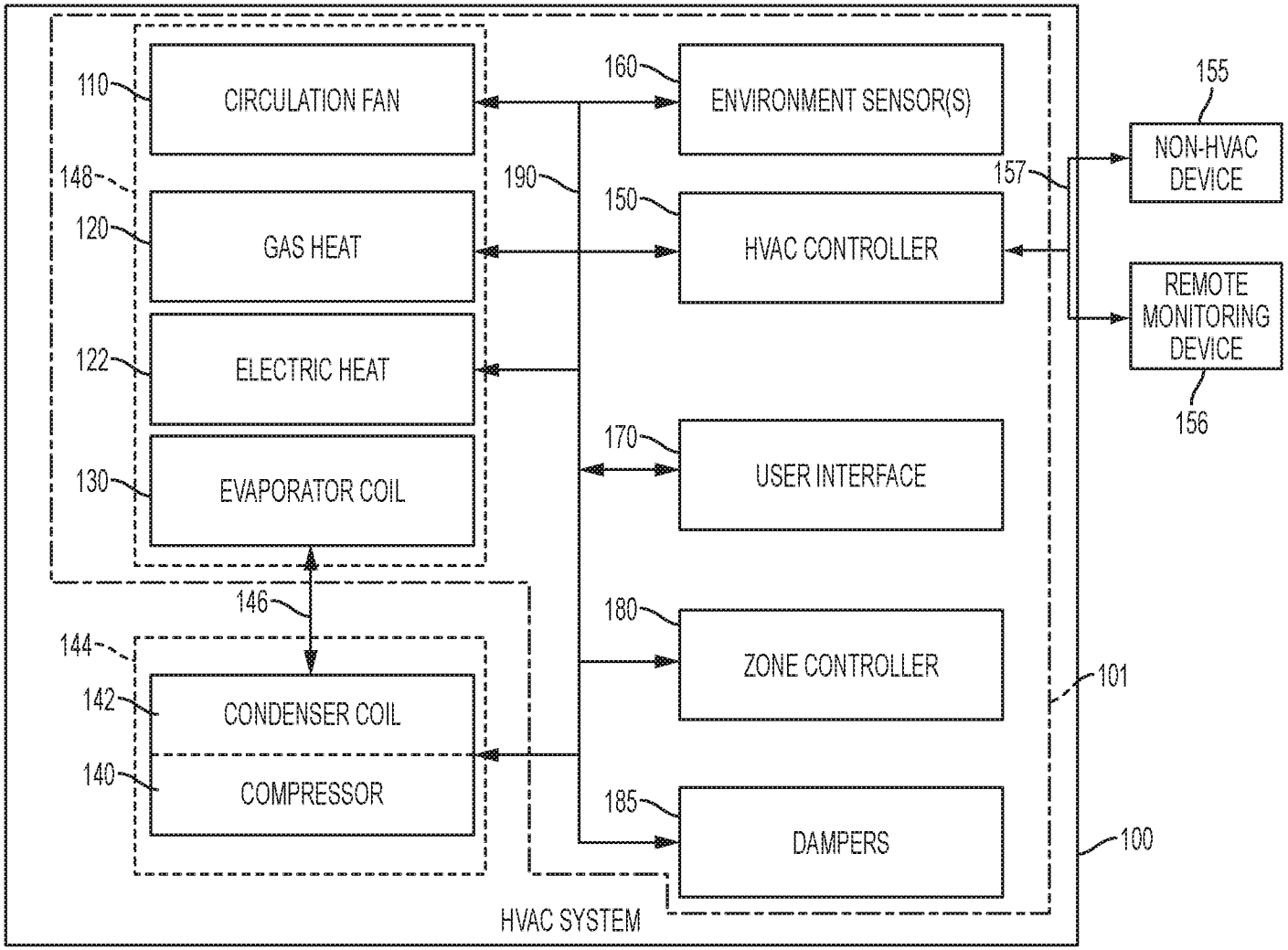
FIG. 1 is a block diagram of an exemplary HVAC system.

Various embodiments will now be described more fully with reference to the accompanying drawings. The disclosure may, however, be embodied in many different forms and should not be construed as limited to the embodiments set forth herein.

HVAC systems are frequently utilized to adjust both temperature of conditioned air as well as relative humidity of the conditioned air. A cooling capacity of an HVAC system is a combination of the HVAC system's sensible cooling capacity and latent cooling capacity. Sensible cooling capacity refers to an ability of the HVAC system to remove sensible heat from conditioned air. Latent cooling capacity refers to an ability of the HVAC system to remove latent heat from conditioned air. Sensible cooling capacity and latent cooling capacity vary with environmental conditions. Sensible heat refers to heat that, when added to or removed from the conditioned air, results in a temperature change of the conditioned air. Latent heat refers to heat that, when added to or removed from the conditioned air, results in a phase change of, for example, water within the conditioned air. Sensible-to-total ratio ("S/T ratio") is a ratio of sensible heat to total heat (sensible heat+latent heat). The lower the S/T ratio, the higher the latent cooling capacity of the HVAC system for given environmental conditions.

Sensible cooling load refers to an amount of heat that must be removed from the enclosed space to accomplish a desired temperature change of the air within the enclosed space. The sensible cooling load is reflected by a temperature within the enclosed space as read on a dry-bulb thermometer. Latent cooling load refers to an amount of heat that must be removed from the enclosed space to accomplish a desired change in humidity of the air within the enclosed space. The latent cooling load is reflected by a temperature within the enclosed space as read on a wet-bulb thermometer. Setpoint or temperature setpoint refers to a target temperature setting of the HVAC system as set by a user or automatically based on a pre-defined schedule.

When there is a high sensible cooling load such as, for example, when outside-air temperature is significantly warmer than an inside-air temperature setpoint, the HVAC system will continue to operate in an effort to effectively cool and dehumidify the conditioned air. Such operation of the HVAC system is known as "cooling mode." When there is a low sensible cooling load but high relative humidity such as, for example, when the outside air temperature is relatively close to the inside air temperature setpoint, but the outside air is considerably more humid than the inside air, supplemental air dehumidification is often undertaken to avoid occupant discomfort. Such operation of the HVAC system is known as "re-heat mode."

An existing approach to air dehumidification involves lowering the temperature setpoint of the HVAC system. This approach causes the HVAC system to operate for longer periods of time than if the temperature setpoint of the HVAC system were set to a higher temperature. This approach serves to reduce both the temperature and humidity of the conditioned air. However, this approach results in over-cooling of the conditioned air, which over-cooling often results in occupant discomfort. Additionally, consequent extended run times cause the HVAC system to consume more energy, which leads to higher utility costs.

Another air dehumidification approach involves re-heating of air leaving an evaporator coil. This approach may also result in over-cooling of the conditioned air and results in occupant discomfort.

FIG. 1 illustrates an HVAC system 100. In various embodiments, the HVAC system 100 is a networked HVAC system that is configured to condition air via, for example, heating, cooling, humidifying, or dehumidifying air within an enclosed space 101. In various embodiments, the enclosed space 101 is, for example, a house, an office building, a warehouse, and the like. Thus, the HVAC system 100 can be a residential system or a commercial system such as, for example, a roof top system. For exemplary illustration, the HVAC system 100 as illustrated in FIG. 1 includes various components; however, in other embodiments, the HVAC system 100 may include additional components that are not illustrated but typically included within HVAC systems.

The HVAC system 100 includes a circulation fan 110, a gas heat 120, electric heat 122 typically associated with the circulation fan 110, and a refrigerant evaporator coil 130, also typically associated with the circulation fan 110. The circulation fan 110, the gas heat 120, the electric heat 122, and the refrigerant evaporator coil 130 are collectively referred to as an "indoor unit" 148. In various embodiments, the indoor unit 148 is located within, or in close proximity to, the enclosed space 101. The HVAC system 100 also includes a compressor 140 and an associated condenser coil 142, which are typically referred to as an "outdoor unit" 144. In various embodiments, the outdoor unit 144 is, for example, a rooftop unit or a ground-level unit. The compressor 140 and the associated condenser coil 142 are connected to an associated evaporator coil 130 by a refrigerant line 146. In various embodiments, the compressor 140 is, for example, a single-stage compressor, a multi-stage compressor, a single-speed compressor, or a variable-speed compressor. In various embodiments, the circulation fan 110, sometimes referred to as a blower, may be configured to operate at different capacities (i.e., variable motor speeds) to circulate air through the HVAC system 100, whereby the circulated air is conditioned and supplied to the enclosed space 101.

Still referring to FIG. 1, the HVAC system 100 includes an HVAC controller 150 that is configured to control operation of the various components of the HVAC system 100 such as, for example, the circulation fan 110, the gas heat 120, the electric heat 122, and the compressor 140 to regulate the environment of the enclosed space 101. In some embodiments, the HVAC system 100 can be a zoned system. In such embodiments, the HVAC system 100 includes a zone controller 180, dampers 185, and a plurality of environment sensors 160. In various embodiments, the HVAC controller 150 cooperates with the zone controller 180 and the dampers 185 to regulate the environment of the enclosed space 101.

The HVAC controller 150 may be an integrated controller or a distributed controller that directs operation of the HVAC system 100. The HVAC controller 150 includes an interface to receive, for example, thermostat calls, temperature setpoints, blower control signals, environmental conditions, and operating mode status for various zones of the HVAC system 100. For example, in various embodiments, the environmental conditions may include indoor temperature and relative humidity of the enclosed space 101. In various embodiments, the HVAC controller 150 also includes a processor and a memory to direct operation of the HVAC system 100 including, for example, a speed of the circulation fan 110.

Still referring to FIG. 1, in some embodiments, the plurality of environment sensors 160 are associated with the HVAC controller 150 and also optionally associated with a user interface 170. The plurality of environment sensors 160 provide environmental information within a zone or zones of the enclosed space 101 such as, for example, temperature and humidity of the enclosed space 101 to the HVAC controller 150. The plurality of environment sensors 160 may also send the environmental information to a display of the user interface 170. In some embodiments, the user interface 170 provides additional functions such as, for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to the user. The user interface 170 may also include a display, buttons, a microphone, a speaker, or other components to communicate with the user. Additionally, the user interface 170 may include a processor and memory that is configured to receive user-determined parameters such as, for example, a relative humidity of the enclosed space 101, and calculate operational parameters of the HVAC system 100 as disclosed herein.

In various embodiments, the HVAC system 100 is configured to communicate with a plurality of devices such as, for example, a monitoring device 156, a communication device 155, and the like. In various embodiments, the monitoring device 156 is not part of the HVAC system 100. For example, the monitoring device 156 is a server or computer of a third party such as, for example, a manufacturer, a support entity, a service provider, and the like. In other embodiments, the monitoring device 156 is located at an office of, for example, the manufacturer, the support entity, the service provider, and the like.

In various embodiments, the communication device 155 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In various embodiments, the communication device 155 includes at least one processor, memory and a user interface, such as a display. One skilled in the art will also understand that the communication device 155 disclosed herein includes other components that are typically included in such devices including, for example, a power supply, a communications interface, and the like.

The zone controller 180 is configured to manage movement of conditioned air to designated zones of the enclosed space 101. Each of the designated zones include at least one conditioning or demand unit such as, for example, the gas heat 120 and at least one user interface 170 such as, for example, the thermostat. The zone-controlled HVAC system 100 allows the user to independently control the temperature in the designated zones. In various embodiments, the zone controller 180 operates electronic dampers 185 to control air flow to the zones of the enclosed space 101.

In some embodiments, a data bus 190, which in the illustrated embodiment is a serial bus, couples various components of the HVAC system 100 together such that data is communicated therebetween. The data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cable and contacts may be used to couple the HVAC controller 150 to the various components. In some embodiments, a wireless connection is employed to provide at least some of the connections between components of the HVAC system such as, for example, a connection between the HVAC controller 150 and the circulation fan 110 or the plurality of environment sensors 160.

Figure 2:
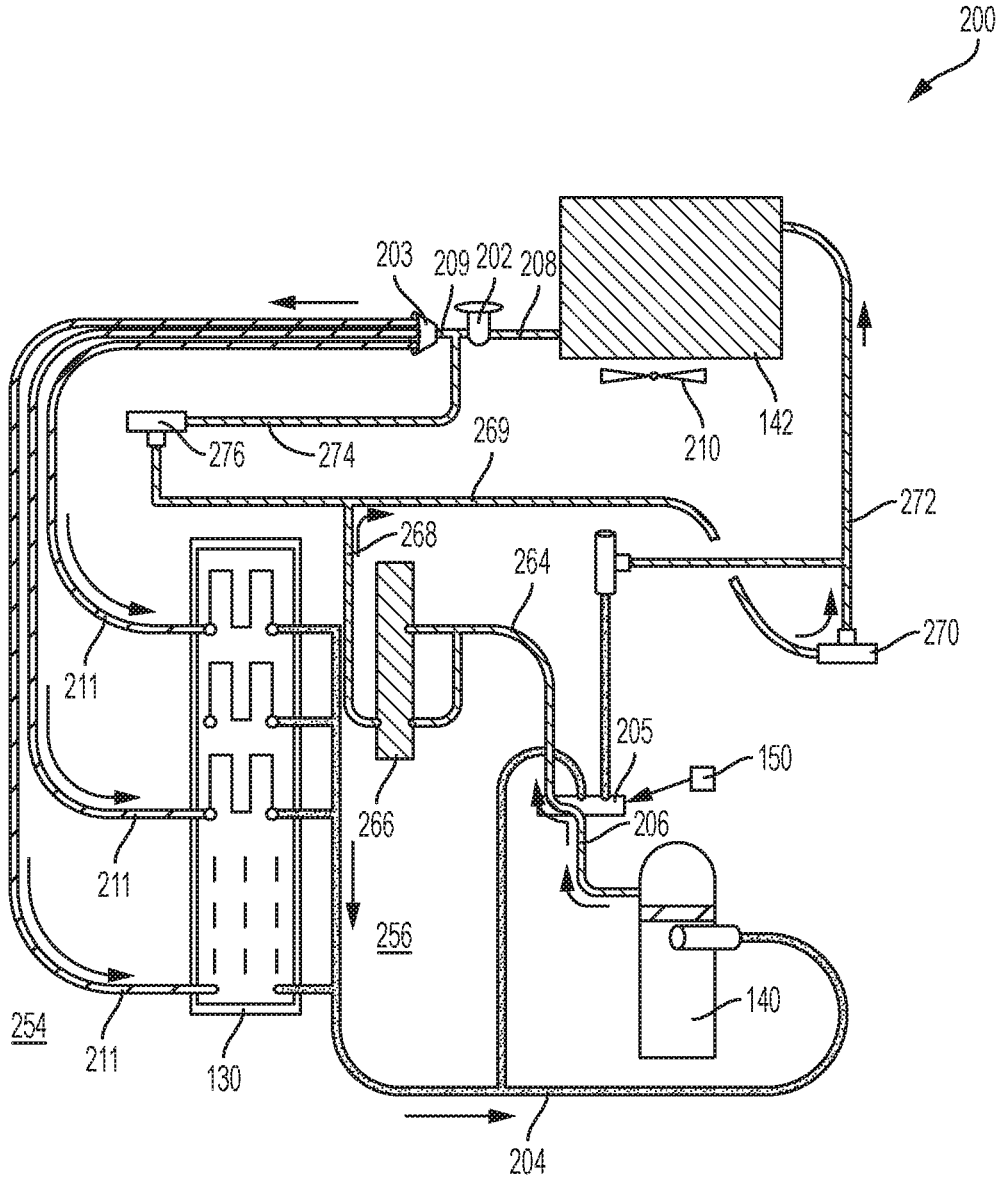
FIG. 2 is a schematic diagram on an exemplary HVAC system with a re-heat coil operating in re-heat mode.

FIG. 2 is a schematic diagram of an HVAC system 200 with a re-heat coil 266 operating in re-heat mode. The HVAC system 200 includes the refrigerant evaporator coil 130, the condenser coil 142, the compressor 140, a metering device 202, and a distributor 203. In various embodiments, the metering device 202 is, for example, a thermostatic expansion valve or a throttling valve. The refrigerant evaporator coil 130 is fluidly coupled to the compressor 140 via a suction line 204. The compressor 140 is fluidly coupled to a reversing valve 205 via a discharge line 206. The reversing valve 205 is electrically coupled to the HVAC controller 150 via, for example, a wired or a wireless connection. In a re-heat mode, the HVAC controller 150 signals the reversing valve 205 to fluidly couple the discharge line 206 to a first re-heat feed line 264. The first re-heat feed line 264 is fluidly coupled to a re-heat coil 266. A re-heat return line 268 fluidly couples the re-heat coil 266 to the condenser coil 142 via a connecting line 269. The condenser coil 142 is fluidly coupled to the metering device 202 via a liquid line 208. The distributor 203 is fluidly coupled to the metering device 202 via an evaporator intake line 209. The distributor 203 divides refrigerant flow into a plurality of evaporator circuit lines 211 and directs refrigerant to the refrigerant evaporator coil 130. In the embodiment illustrated in FIG. 2, three evaporator circuit lines 211 are shown by way of example; however, in other embodiments, the distributor 203 could divide refrigerant flow into any number of evaporator circuit lines 211.

Still referring to FIG. 2, during operation, low-pressure, low-temperature refrigerant is circulated through the refrigerant evaporator coil 130. The refrigerant is initially in a liquid: vapor state. In various embodiments, the refrigerant is, for example, R-22, R-134a, 410A, R-744, or any other suitable type of refrigerant as dictated by design requirements. Air from within the enclosed space 101, which is typically wanner than the refrigerant, is circulated around the refrigerant evaporator coil 130 by the circulation fan 110. The refrigerant begins to boil after absorbing heat from the air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant enters the reversing valve 205 where, when operating in re-heat mode, the high-pressure, high-temperature, super-heated vapor refrigerant is directed into the first re-heat feed line 264. The first re-heat feed line 264 directs the high-pressure, high-temperature, superheated vapor refrigerant to the re-heat coil 266. The re-heat coil 266 is positioned downwind from the evaporator coil 130 such that air circulated by the circulation fan 110 passes through the evaporator coil 130 before passing through the re-heat coil 266. The re-heat coil 266 facilitates transfer of a portion of the heat stored in the high-pressure, high-temperature, superheated vapor refrigerant to air moving through a supply air duct 256 thereby heating the air in the supply air duct 256. If the high-pressure, high-temperature, superheated vapor refrigerant is warmer, more heat can be transferred to the air in the supply air duct 256 thereby causing a temperature of the air in the supply air duct 256 to be closer to a temperature of air in a return air duct 254. After leaving the re-heat coil 266, the high-pressure, high-temperature, superheated vapor refrigerant travels through a re-heat return line 268 to a connecting line 269. A first check valve 270 couples the connecting line 269 to a condenser intake line 272. In various embodiments, the first check valve 270 operates responsive to pressure in the connecting line 269 relative to pressure in the condenser intake line 272 and prevents backflow of refrigerant into the connecting line 269. That is, if pressure in the condenser intake line 272 exceeds pressure in the connecting line 269, the first check valve 270 closes and prevents backflow of refrigerant into the connecting line 269.

Still referring to FIG. 2, a second re-heat feed line 274 is fluidly coupled to the evaporator intake line 209. A second check valve 276 fluidly couples the second re-heat feed line 274 to the connecting line 269. In various embodiments, the second check valve 276 operates responsive to pressure in the connecting line 269 relative to pressure in the second re-heat feed line 274 and prevents backflow of refrigerant into the second re-heat feed line 274. That is, if pressure in the connecting line 269 exceeds pressure in the second re-heat feed line 274, the second check valve 276 doses and prevents backflow of refrigerant into the second re-heat feed line 274.

Outside air is circulated around the condenser coil 142 by a condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure of the high-pressure, high-temperature, sub-cooled liquid refrigerant is abruptly reduced due to, for example, regulation of an amount of refrigerant that travels to the distributor 203. Abrupt reduction of the pressure of the high-pressure, high-temperature, sub-cooled liquid refrigerant causes sudden, rapid, evaporation of a portion of the high-pressure, high-temperature, sub-cooled liquid refrigerant, commonly known as flash evaporation. Flash evaporation lowers the temperature of the resulting liquid/vapor refrigerant mixture to a temperature lower than a temperature of the air in the enclosed space 101. The liquid/vapor refrigerant mixture leaves the metering device 202 and enters the distributor 203 via the evaporator intake line 209. The distributor 203 divides refrigerant flow into a plurality of evaporator circuit lines 211 and directs refrigerant to the refrigerant evaporator coil 130.

Figure 3:
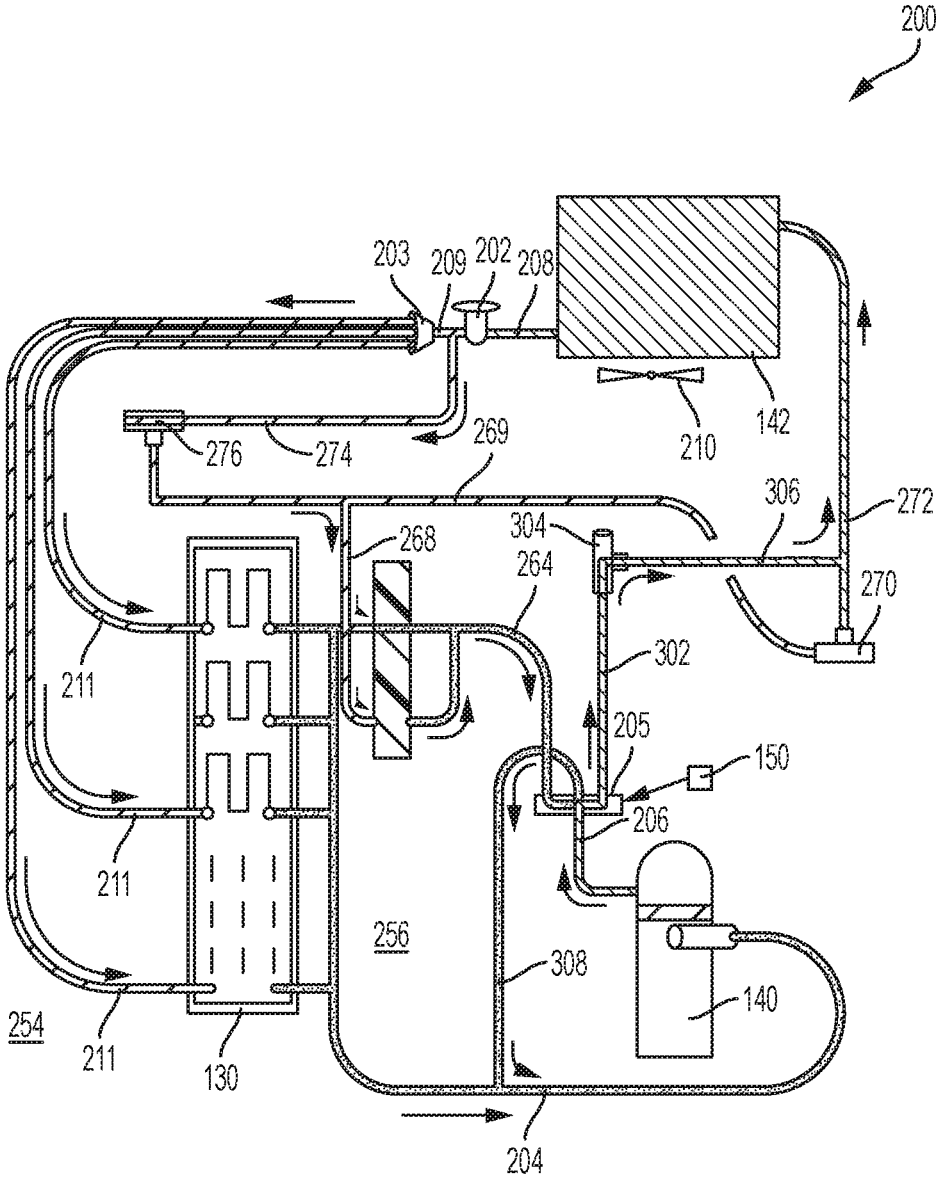
FIG. 3 is a schematic diagram of the exemplary HVAC system of FIG. 2 operating in cooling mode.

FIG. 3 is a schematic diagram of the exemplary HVAC system 200 of FIG. 2 operating in cooling mode. For purposes of illustration, FIG. 3 is described herein relative to FIGS. 1-2. During operation, low-pressure, low-temperature refrigerant is circulated through the refrigerant evaporator coil 130. The refrigerant is initially in a liquid/vapor state. Air from within the enclosed space 101, which is typically warmer than the refrigerant, is circulated around the refrigerant evaporator coil 130 by the circulation fan 110. The refrigerant begins to boil after absorbing heat from the air and changes state to a low-pressure, low-temperature, superheated vapor refrigerant.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant enters the reversing valve 205 where, when operating in cooling mode, the high-pressure, high-temperature, superheated vapor refrigerant is directed into the second discharge line 302. A third check valve 304 fluidly couples the second discharge line 302 to a third discharge line 306. The third discharge line 306 is fluidly coupled to the condenser intake line 272. Thus, when operating in cooling mode, the condenser intake line 272 contains high-pressure, high-temperature, superheated vapor refrigerant. Thus, the pressure in the condenser intake line 272 exceeds the pressure in the connecting line 269 thereby causing the first check valve 270 to close and prevents backflow of refrigerant into the connecting line 269.

Outside air is circulated around the condenser coil 142 by the condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure and temperature of the high-pressure, high-temperature, sub-cooled liquid refrigerant is abruptly reduced due to, for example, regulation of an amount of refrigerant that travels to the distributor 203. Flash evaporation lowers the temperature of the resulting liquid/vapor refrigerant mixture to a temperature lower than a temperature of the air in the enclosed space 101. The liquid/vapor refrigerant mixture leaves the metering device 202 and enters the distributor 203 via the evaporator intake line 209. The distributor 203 divides refrigerant flow into a plurality of evaporator circuit lines 211 and directs refrigerant to the refrigerant evaporator coil 130.

Still referring to FIG. 3, the second re-heat feed line 274 is fluidly coupled to the evaporator intake line 209. A portion of liquid/vapor refrigerant is diverted from the evaporator intake line 209 into the second re-heat feed line 274. The second check valve 276 fluidly couples the second re-heat feed line 274 to the connecting line 269. When operating in cooling mode, the pressure in the connecting line 269 is approximately equal to the pressure in the second re-heat feed line 274. Thus, the second check valve 276 permits flow of the liquid/vapor refrigerant from the second re-heat feed line 274 into the connecting line 269. From the connecting line 269, the liquid/vapor refrigerant passes through the re-heat return line 268 and enters the re-heat coil 266. During cooling, the re-heat coil 266 absorbs additional heat from air in the supply air duct 256 and thereby facilitates further cooling of the air in the supply air duct 256. In this manner, the re-heat coil 266 functions as a second-stage evaporator when operating in cooling mode. In the re-heat coil 266, the refrigerant begins to boil after absorbing heat from the air and changes state to a low-pressure, low-temperature, super-heated vapor refrigerant.

Still referring to FIG. 3, the low-pressure, low-temperature, super-heated vapor refrigerant leaves the re-heat coil 266 via the first re-heat feed line 264. The low-pressure, low-temperature, super-heated vapor refrigerant then enters the reversing valve 205. In cooling mode, the HVAC controller 150 signals the reversing valve 205 to couple the first re-heat feed line 264 to a second suction line 308. The second suction line 308 is fluidly coupled to the suction line 204, which directs the low-pressure, low-temperature, super-heated vapor refrigerant to the compressor 140.

Figure 4:
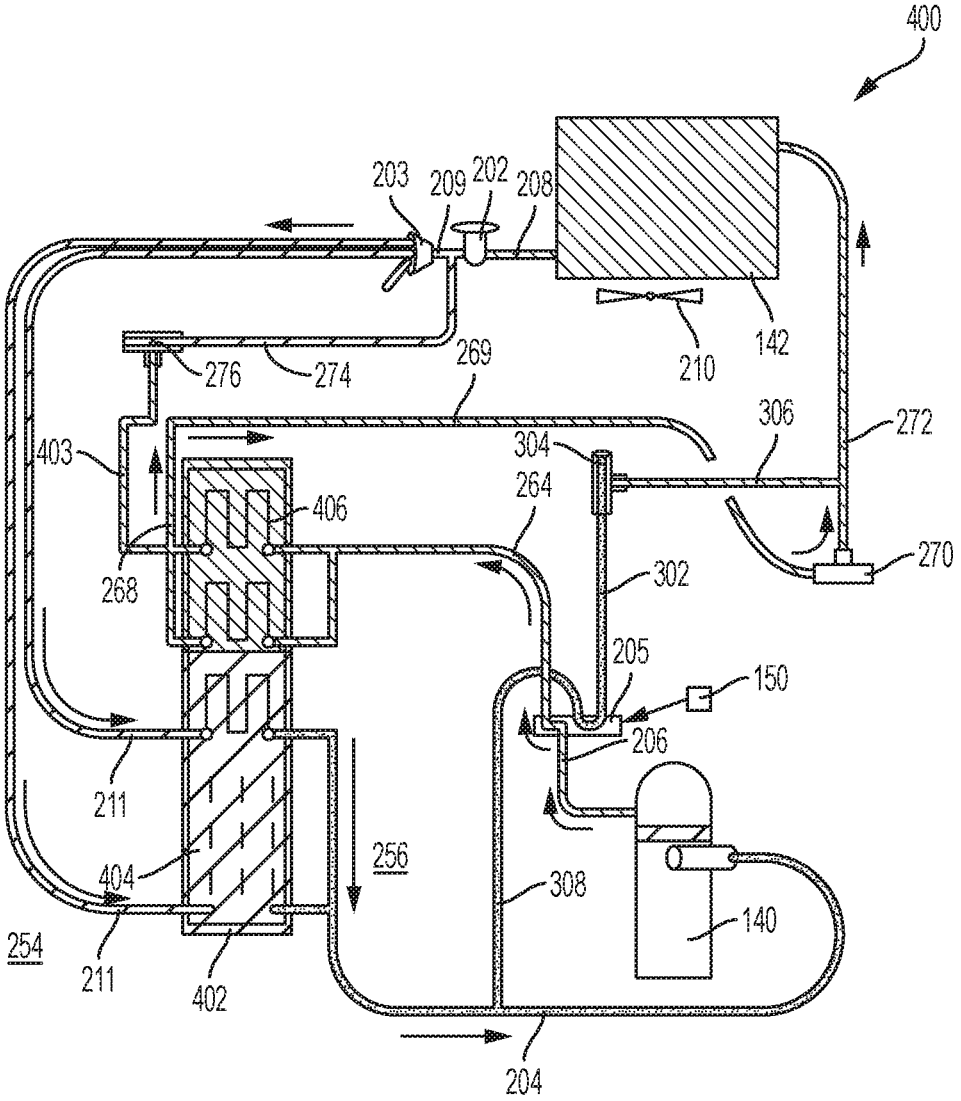
FIG. 4 is a schematic diagram of an exemplary HVAC system with a segmented evaporator operating in re-heat mode.

FIG. 4 is a schematic diagram of an exemplary HVAC system 400 with a segmented evaporator coil 402 operating in re-heat mode. For purposes of illustration, FIG. 4 is described herein relative to FIG. 1. In various embodiments, the segmented evaporator coil 402 includes a primary segment 404 and a secondary segment 406. When operating in re-heat mode, the secondary segment 406 operates as a re-heat coil. When operating in cooling mode, the secondary segment operates as an evaporator.

Still referring to FIG. 4, during operation, low-pressure, low-temperature refrigerant is circulated through the primary segment 404. The refrigerant is initially in a liquid/vapor state. The refrigerant is, for example, R-22, R-134a, R-410A, R-744, or any other suitable type of refrigerant as dictated by design requirements. Air from within the enclosed space 101, which is typically wanner than the refrigerant, is circulated around the primary segment 404 by the circulation fan 110. The refrigerant begins to boil after absorbing heat from the air and changes state to a low-pressure, low-temperature, super-heated vapor refrigerant.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant enters the reversing valve 205 where, when operating in re-heat mode, the high-pressure, high-temperature, superheated vapor refrigerant is directed into the first re-heat feed line 264. The first re-heat feed line 264 directs the high-pressure, high-temperature, superheated vapor refrigerant to the secondary segment 406. The secondary segment 406 facilitates transfer of a portion of the heat stored in the high-pressure, high-temperature, superheated vapor refrigerant to air moving through the supply air duct 256 thereby heating the air in the supply air duct 256. If the high-pressure, high-temperature, superheated vapor refrigerant is warmer, more heat can be transferred to the air in the supply air duct 256 thereby causing a temperature of the air in the supply air duct 256 to be closer to a temperature of air in the return air duct 254. After leaving the secondary segment 406, the high-pressure, high-temperature, superheated vapor refrigerant travels through a re-heat return line 268 to a connecting line 269. When operating in re-heat mode, the pressure in the connecting line 269 is approximately equal to the pressure in the condenser intake line 272. In such a scenario, the first check valve 270 permits flow of refrigerant from the connecting line 269 into the condenser intake line 272. When operating in re-heat mode, the pressure in the third discharge line 306 exceeds the pressure in the second discharge line 302. Thus, the third check valve 304 closes preventing backflow of refrigerant into the second discharge line 302.

Still referring to FIG. 4, the second re-heat feed line 274 is fluidly coupled to the evaporator intake line 209. When operating in re-heat mode, pressure in a evaporator circuit line 403 exceeds pressure in the second re-heat feed line 274. Thus, the second check valve 276 closes and prevents backflow of refrigerant into the second re-heat feed line 274.

Outside air is circulated around the condenser coil 142 by a condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the temperature pressure of the high-pressure, high-temperature, sub-cooled liquid refrigerant is abruptly reduced due to, for example, regulation of an amount of refrigerant that travels to the distributor 203. Flash evaporation lowers the temperature of the resulting liquid/vapor refrigerant mixture to a temperature lower than a temperature of the air in the enclosed space 101. The liquid/vapor refrigerant mixture leaves the metering device 202 and enters the distributor 203 via the evaporator intake line 209. The distributor 203 divides refrigerant flow into a plurality of evaporator circuit lines 211 and directs refrigerant to the primary segment 404 of the segmented evaporator coil 402.

Figure 5:
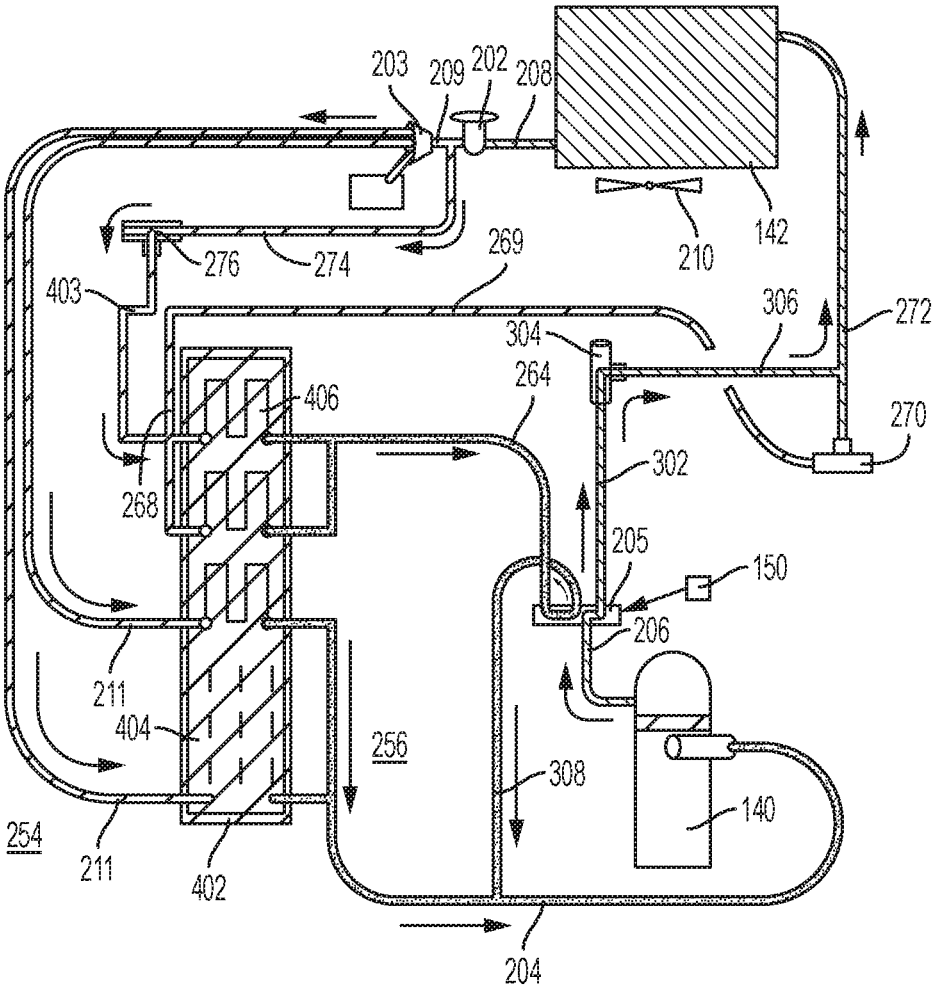
FIG. 5 is a schematic diagram of the exemplary HVAC system of FIG. 4 with a segmented evaporator operating in cooling mode.

FIG. 5 is a schematic diagram of the exemplary HVAC system 400 of FIG. 4 with the segmented evaporator coil 402 operating in cooling mode. For purposes of illustration, FIG. 5 is described herein relative to FIGS. 1 and 4. During operation, low-pressure, low-temperature refrigerant is circulated through the primary segment 404 and the secondary segment 406 of the segmented evaporator coil 402. The refrigerant is initially in a liquid/vapor state. Air from within the enclosed space 101, which is typically warmer than the refrigerant, is circulated around the segmented evaporator coil 402 by the circulation fan 110. The refrigerant begins to boil after absorbing heat from the air and changes state to a low-pressure, low-temperature, super-heated vapor refrigerant.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant enters the reversing valve 205 where, when operating in cooling mode, the high-pressure, high-temperature, superheated vapor refrigerant is directed into the second discharge line 302. A third check valve 304 fluidly couples the second discharge line 302 to a third discharge line 306. The third discharge line 306 is fluidly coupled to the condenser intake line 272. Thus, when operating in cooling mode, the condenser intake line 272 contains high-pressure, high-temperature, superheated vapor refrigerant. Thus, the pressure in the condenser intake line 272 exceeds the pressure in the connecting line 269 thereby causing the first check valve 270 to close and prevent backflow of refrigerant into the connecting line 269.

Outside air is circulated around the condenser coil 142 by the condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure and temperature of the high-pressure, high-temperature, sub-cooled liquid refrigerant is abruptly reduced due to, for example, regulation of an amount of refrigerant that travels to the distributor 203. Flash evaporation lowers the temperature of the resulting liquid/vapor refrigerant mixture to a temperature lower than a temperature of the air in the enclosed space 101. The liquid/vapor refrigerant mixture leaves the metering device 202 and enters the distributor 203 via the evaporator intake line 209. The distributor 203 divides refrigerant flow into a plurality of evaporator circuit lines 211 and directs refrigerant to the refrigerant evaporator coil 130.

Still referring to FIG. 5, the second re-heat feed line 274 is fluidly coupled to the evaporator intake line 209. A portion of liquid/vapor refrigerant is diverted from the evaporator intake line 209 into the second re-heat feed line 274. The second check valve 276 fluidly couples the second re-heat feed line 274 to the evaporator circuit line 403. When operating in cooling mode, the pressure in the evaporator circuit line 403 is approximately equal to the pressure in the second re-heat feed line 274. Thus, the second check valve 276 permits flow of the liquid/vapor refrigerant from the second re-heat feed line 274 into the evaporator circuit line 403. From the evaporator circuit line 403, the liquid/vapor refrigerant passes into the secondary segment 406. During cooling, the secondary segment 406 absorbs additional heat from air in the supply air duct 256 and thereby facilitates further cooling of the air in the supply air duct 256. In the secondary segment 406, the refrigerant begins to boil after absorbing heat from the air and changes state to a low-pressure, low-temperature, super-heated vapor refrigerant.

Still referring to FIG. 5, the low-pressure, low-temperature, super-heated vapor refrigerant leaves the secondary segment 406 via the first re-heat feed line 264. The low-pressure, low-temperature, super-heated vapor refrigerant then enters the reversing valve 205. In cooling mode, the HVAC controller signals the reversing valve 205 to couple the first re-heat feed line 264 to a second suction line 308. The second suction line 308 is fluidly coupled to the suction line 204, which directs the low-pressure, low-temperature, super-heated vapor refrigerant to the compressor 140.

Figure 6:
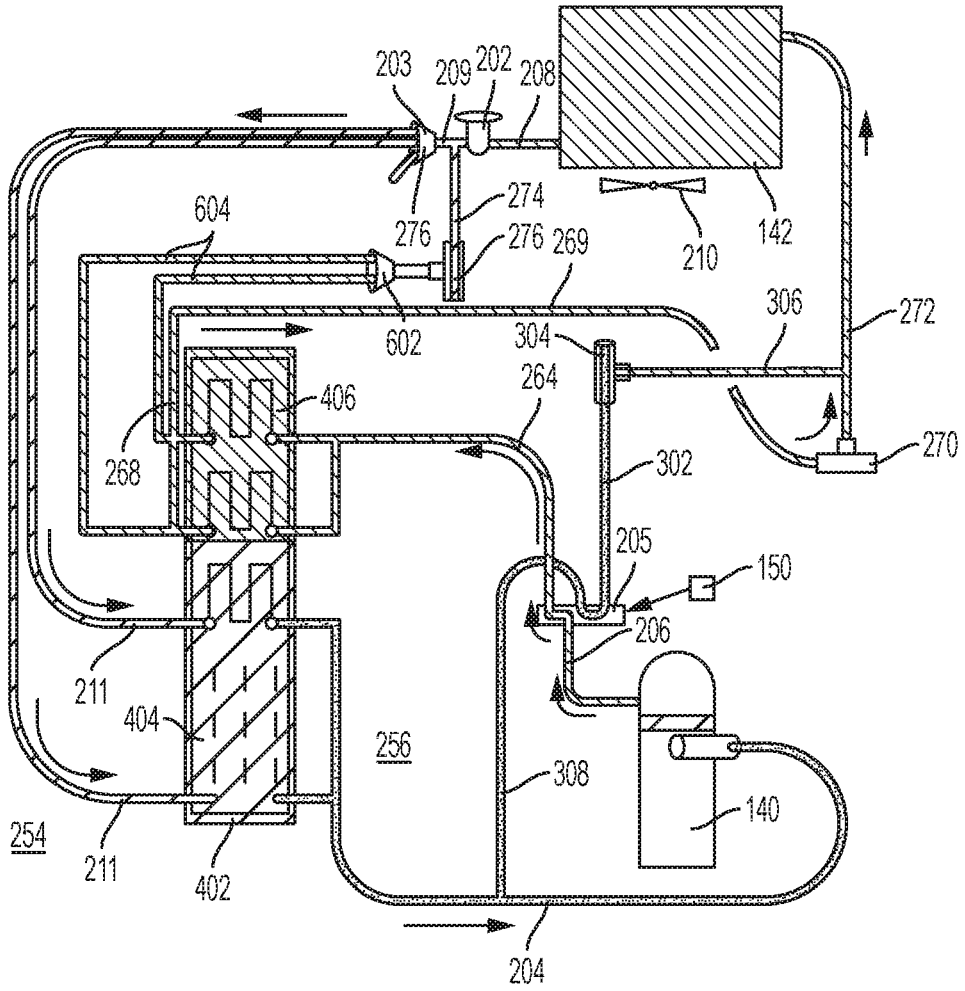
FIG. 6 is a schematic diagram of an exemplary HVAC system with a second distributor operating in re-heat mode.

FIG. 6 is a schematic diagram of an exemplary HVAC system 600 with a second distributor 602 operating in re-heat mode. For purposes of illustration, FIG. 6 is described herein relative to FIG. 1. During operation, low-pressure, low-temperature refrigerant is circulated through the primary segment 404. The refrigerant is initially in a liquid/vapor state. The refrigerant is, for example, R-22, R-134a, R-410A, R-744, or any other suitable type of refrigerant as dictated by design requirements. Air from within the enclosed space 101, which is typically warmer than the refrigerant, is circulated around the primary segment 404 by the circulation fan 110. The refrigerant begins to boil after absorbing heat from the air and changes state to a low-pressure, low-temperature, super-heated vapor refrigerant.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant enters the reversing valve 205 where, when operating in re-heat mode, the high-pressure, high-temperature, superheated vapor refrigerant is directed into the first re-heat feed line 264. The first re-heat feed line 264 directs the high-pressure, high-temperature, superheated vapor refrigerant to the secondary segment 406. The secondary segment 406 facilitates transfer of a portion of the heat stored in the high-pressure, high-temperature, superheated vapor refrigerant to air moving through the supply air duct 256 thereby heating the air in the supply air duct 256. If the high-pressure, high-temperature, superheated vapor refrigerant is warmer, more heat can be transferred to the air in the supply air duct 256 thereby causing a temperature of the air in the supply air duct 256 to be closer to a temperature of air in the return air duct 254. After leaving the secondary segment 406, the high-pressure, high-temperature, superheated vapor refrigerant travels through a re-heat return line 268 to a connecting line 269. When operating in re-heat mode, the pressure in the connecting line 269 is approximately equal to the pressure in the condenser intake line 272. In such a scenario, the first check valve 270 permits flow of refrigerant from the connecting line 269 into the condenser intake line 272. When operating in re-heat mode, the pressure in the third discharge line 306 exceeds the pressure in the second discharge line 302. Thus, the third check valve 304 closes preventing backflow of refrigerant into the second discharge line 302.

Still referring to FIG. 6, the second re-heat feed line 274 is fluidly coupled to the evaporator intake line 209. When operating in re-heat mode, pressure in the connecting line 269 exceeds pressure in the second re-heat feed line 274. Thus, the second check valve 276 closes and prevents backflow of refrigerant into the second re-heat feed line 274. The second distributor 602 is fluidly coupled to the second re-heat feed line 274. The second distributor 602 divides flow of refrigerant into a second plurality of circuit lines 604, which are fluidly coupled to the secondary segment 406.

Outside air is circulated around the condenser coil 142 by a condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the temperature pressure of the high-pressure, high-temperature, sub-cooled liquid refrigerant is abruptly reduced due to, for example, regulation of an amount of refrigerant that travels to the distributor 203. Flash evaporation lowers the temperature of the resulting liquid/vapor refrigerant mixture to a temperature lower than a temperature of the air in the enclosed space 101. The liquid/vapor refrigerant mixture leaves the metering device 202 and enters the distributor 203 via the evaporator intake line 209. The distributor 203 divides refrigerant flow into a plurality of evaporator circuit lines 211 and directs refrigerant to the primary segment 404 of the segmented evaporator coil 402.

Figure 7:
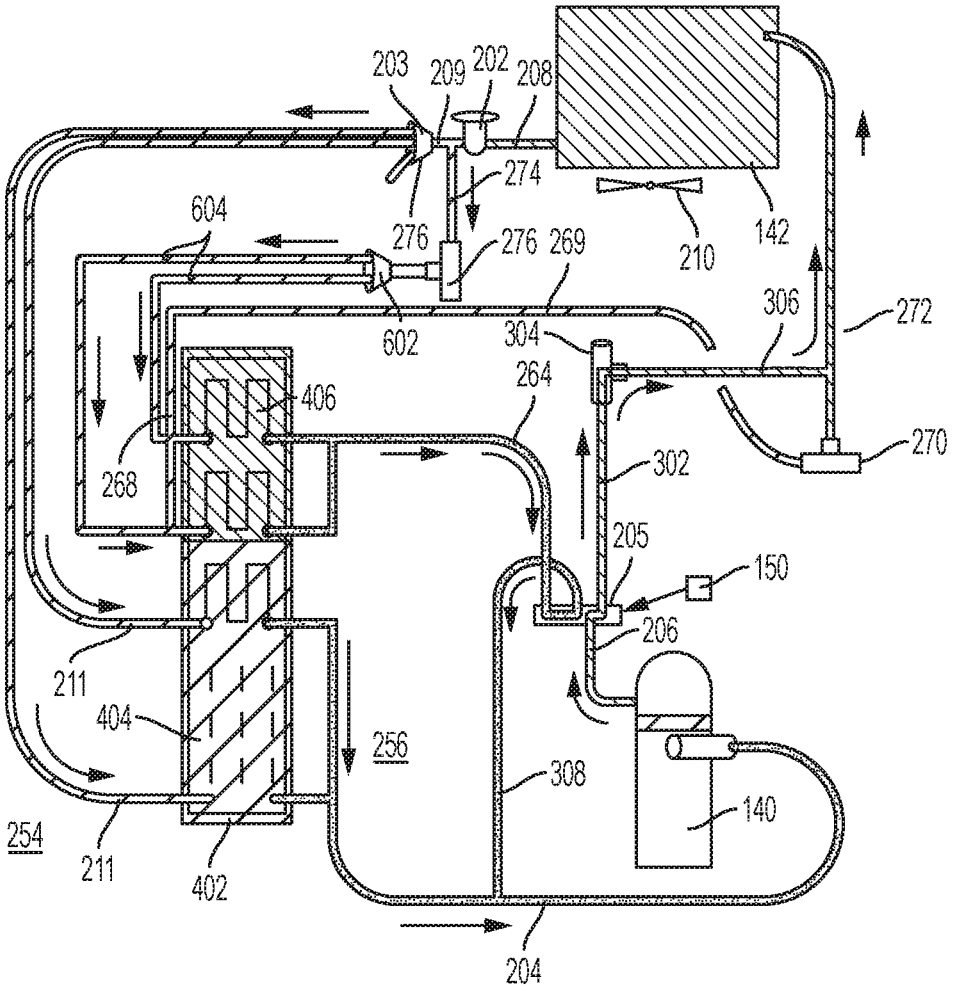
FIG. 7 is a schematic diagram of the exemplary HVAC system of FIG. 6 with a second distributor operating in cooling mode.

FIG. 7 is a schematic diagram of the exemplary HVAC system 600 of FIG. 6 with the second distributor 602 operating in cooling mode. For purposes of illustration, FIG. 7 is described herein relative to FIGS. 1 and 6. During operation, low-pressure, low-temperature refrigerant is circulated through the primary segment 404 and the secondary segment 406 of the segmented evaporator coil 402. The refrigerant is initially in a liquid/vapor state. Air from within the enclosed space 101, which is typically warmer than the refrigerant, is circulated around the segmented evaporator coil 402 by the circulation fan 110. The refrigerant begins to boil after absorbing heat from the air and changes state to a low-pressure, low-temperature, super-heated vapor refrigerant.

The low-pressure, low-temperature, super-heated vapor refrigerant is introduced into the compressor 140 via the suction line 204. The compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant enters the reversing valve 205 where, when operating in cooling mode, the high-pressure, high-temperature, superheated vapor refrigerant is directed into the second discharge line 302. A third check valve 304 fluidly couples the second discharge line 302 to a third discharge line 306. The third discharge line 306 is fluidly coupled to the condenser intake line 272. Thus, when operating in cooling mode, the condenser intake line 272 contains high-pressure, high-temperature, superheated vapor refrigerant. Thus, the pressure in the condenser intake line 272 exceeds the pressure in the connecting line 269 thereby causing the first check valve 270 to close and prevent backflow of refrigerant into the connecting line 269.

Outside air is circulated around the condenser coil 142 by the condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure and temperature of the high-pressure, high-temperature, sub-cooled liquid refrigerant is abruptly reduced due to, for example, regulation of an amount of refrigerant that travels to the distributor 203. Flash evaporation lowers the temperature of the resulting liquid/vapor refrigerant mixture to a temperature lower than a temperature of the air in the enclosed space 101. The liquid/vapor refrigerant mixture leaves the metering device 202 and enters the distributor 203 via the evaporator intake line 209. The distributor 203 divides refrigerant flow into a plurality of evaporator circuit lines 211 and directs refrigerant to the refrigerant evaporator coil 130.

Still referring to FIG. 7, the second re-heat feed line 274 is fluidly coupled to the evaporator intake line 209. A portion of liquid/vapor refrigerant is diverted from the evaporator intake line 209 into the second re-heat feed line 274. The second check valve 276 fluidly couples the second re-heat feed line 274 to the second distributor 602. When operating in cooling mode, the pressure in the connecting line 269 is approximately equal to the pressure in the second distributor 602. Thus, the second check valve 276 permits flow of the liquid/vapor refrigerant from the second re-heat feed line 274 into the second distributor 602. From the second distributor 602, the liquid/vapor refrigerant passes through the second plurality of circuit lines 604 and into the secondary segment 406. During cooling, the secondary segment 406 absorbs additional heat from air in the supply air duct 256 and thereby facilitates further cooling of the air in the supply air duct 256. In the secondary segment 406, the refrigerant begins to boil after absorbing heat from the air and changes state to a low-pressure, low-temperature, super-heated vapor refrigerant.

Still referring to FIG. 7, the low-pressure, low-temperature, super-heated vapor refrigerant leaves the secondary segment 406 via the first re-heat feed line 264. The low-pressure, low-temperature, super-heated vapor refrigerant then enters the reversing valve 205. In cooling mode, the HVAC controller 150 signals the reversing valve 205 to couple the first re-heat feed line 264 to a second suction line 308. The second suction line 308 is fluidly coupled to the suction line 204, which directs the low-pressure, low-temperature, super-heated vapor refrigerant to the compressor 140.

Figure 8:
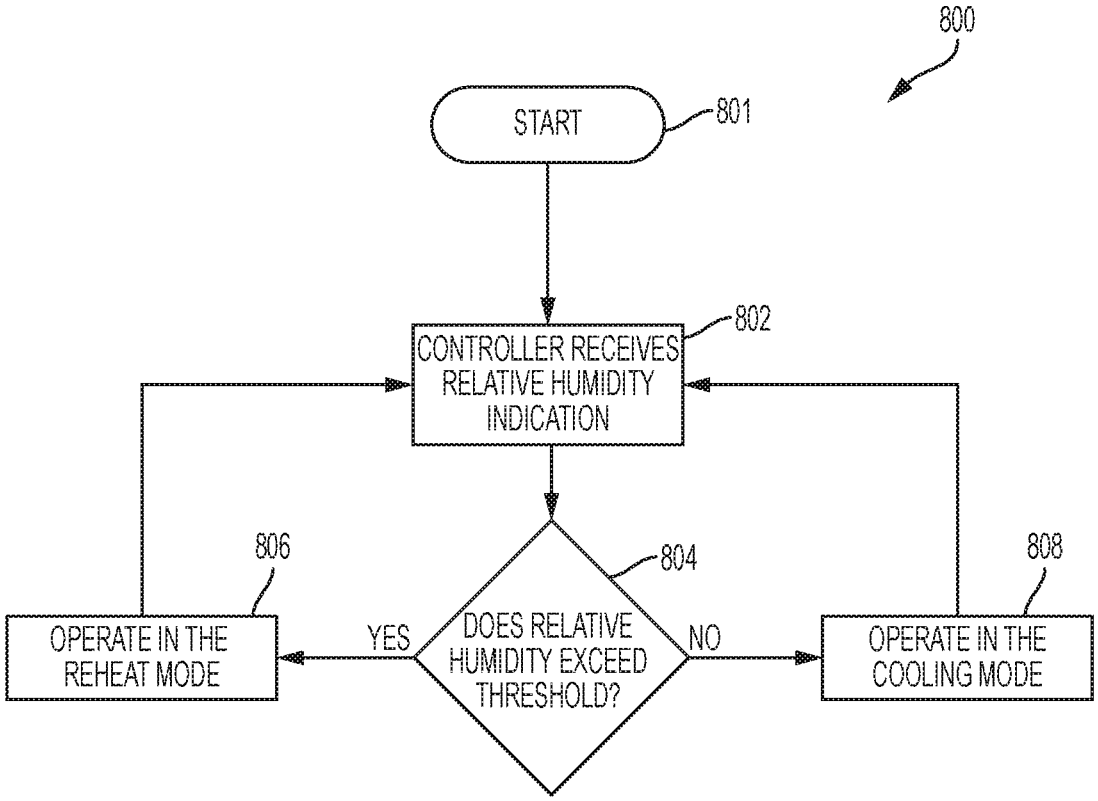
FIG. 8 is a flow diagram of a process for operating an HVAC system in at least one of a cooling mode and a re-heat mode.

FIG. 8 is a flow diagram of a process 800 for operating an HVAC system in at least one of the cooling mode and the re-heat mode. The process 800 starts at step 801. At step 802, the HVAC controller 150 receives an indication of the relative humidity of the enclosed space 101. At step 804, the HVAC controller 150 determines if the indicated relative humidity exceeds a pre-set threshold relative humidity. If, in step 804, it is determined that the indicated relative humidity exceeds the pre-set threshold relative humidity, the process 800 proceeds to step 806. At step 806, the HVAC controller directs the HVAC system to operate in the re-heat mode. Following step 806, the process 800 returns to step 802. If, at step 804, it is determined that the indicated relative humidity does not exceed the pre-set threshold relative humidity, the process 800 proceeds to step 808. At step 808, the HVAC controller 150 directs the HVAC system to operate in the cooling mode. Following step 808, the process 800 returns to step 802.

Depending on the embodiment, certain acts, events, or functions of any of the algorithms, methods, or processes described herein can be performed in a different sequence, can be added, merged, or left out altogether (e.g., not all described acts or events are necessary for the practice of the algorithms, methods, or processes). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A heating, ventilation, and air conditioning ("HVAC") system comprising:

a condenser coil;

a thermostatic expansion valve fluidly coupled to the condenser coil;

a distributor fluidly coupled to the thermostatic expansion valve;

an evaporator coil fluidly coupled to the distributor via a plurality of evaporator circuit lines;

a re-heat coil disposed downwind from the evaporator coil, the re-heat coil being fluidly coupled to the thermostatic expansion valve via a re-heat return line, a connecting line, and a re-heat feed line to form a first flow path, the re-heat coil being fluidly coupled to the condenser coil via, the re-heat return line, the connecting line, and a condenser intake line to form a second flow path, the first flow path and the second flow path sharing a common connection to the re-heat coil via the re-heat return line;

a first check valve disposed between the connecting line and the condenser intake line;

a second check valve disposed between the re-heat return line and the re-heat feed line; and wherein the HVAC system operates in at least one of a cooling mode and a re-heat mode.

2. The HVAC system of claim 1, comprising a compressor fluidly coupled to the evaporator coil and fluidly coupled to the re-heat coil via a reversing valve.

3. The HVAC system of claim 2, wherein, in the re-heat mode, the reversing valve directs refrigerant from the compressor to the re-heat coil.

4. The HVAC system of claim 2, wherein, in the re-heat mode, refrigerant is discharged from the re-heat coil to the condenser via the second flow path.

5. The HVAC system of claim 4, wherein the second check valve prevents flow of refrigerant from the re-heat coil to the thermostatic expansion valve when operating in the re-heat mode.

6. The HVAC system of claim 2, wherein, in a cooling mode, the reversing valve directs refrigerant from the compressor to the condenser coil via a third check valve.

7. The HVAC system of claim 6, wherein, in a cooling mode, refrigerant is discharged from the re-heat coil to the compressor via the reversing valve.

8. The HVAC system of claim 6, wherein the first check valve prevents flow of refrigerant from the condenser to the re-heat coil when operating in cooling mode.

* * * * *